United States Patent [19]

Chen et al.

[11] 4,226,022

[45] Oct. 7, 1980

[54] ELLIPSOGRAPH

[76] Inventors: Jen-Sheng Chen; Jen-Hung Chen, both of 4, Alley 17, Lane 73, Chang Tai St, Taipei 109, Taiwan

[21] Appl. No.: 58,302

[22] Filed: Jul. 17, 1979

[51] Int. Cl.[3] ..... B43L 11/04

[52] U.S. Cl. ..... 33/30 G

[58] Field of Search ..... 33/30 R, 30 D, 30 G, 33/31

[56] References Cited

U.S. PATENT DOCUMENTS

| | | | |
|---|---|---|---|
| 1,876,069 | 9/1932 | O'Byrne | 33/30 G |
| 3,114,974 | 12/1963 | Braginetz | 33/30 D |

*Primary Examiner*—Harry N. Haroian

*Attorney, Agent, or Firm*—Burns, Doane, Swecker & Mathis

[57] ABSTRACT

An ellipsograph comprises an inner toothed horizontal ring gear serving as a support. A diametrically disposed main seat bar is mounted inside of the ring gear and rotatable about the center. A vertical shaft is mounted on the main seat with a revolving arm mounted thereon. A drawing implement such as a pen is slidably mounted on said arm. The main seat bar has a small gear provided on one end of the seat bar to be driven through meshing engagement with the inner teeth of the ring gear. Such movement is transmitted through a series of sprocket and chain trains disposed on the seat bar to the vertical shaft having the revolving arm. The track of the writing implement forms an ellipse when the seat bar is caused to rotate one revolution upon the ring gear.

6 Claims, 5 Drawing Figures

ELLIPSOGRAPH

FIELD OF THE INVENTION

The present invention relates generally to an ellipsograph.

BACKGROUND OF THE INVENTION

Conventional ellipsographs usually comprise a compasses with two spread apart legs. The ellipse drawn therefrom fails to be in exact and ideal form. Sometimes auxiliary lines shall have to be drawn to complete the drawing. It is by no means convenient.

SUMMARY OF THE INVENTION

Therefore the main object of the present invention is to provide an ellipsograph comprising an arrangement of gears, sprockets and chains to move a drawing arm whereby an ellipse of exact proportion is drawn.

Another object of the present invention is to provide an ellipsograph which is stably constructed according to the principle of ellipse forming and the major axis and minor axis are adjustable as desired.

Still another object of the present invention is to provide an ellipsograph, where a dotted track is produced through the guide of a disc having a corrugated edge.

Other object and features of the present invention will become clear from the following description taken in conjunction with the annexed drawings.

DETAILED DESCRIPTION OF PREFERRED EMBODIMENT

Figure 1:
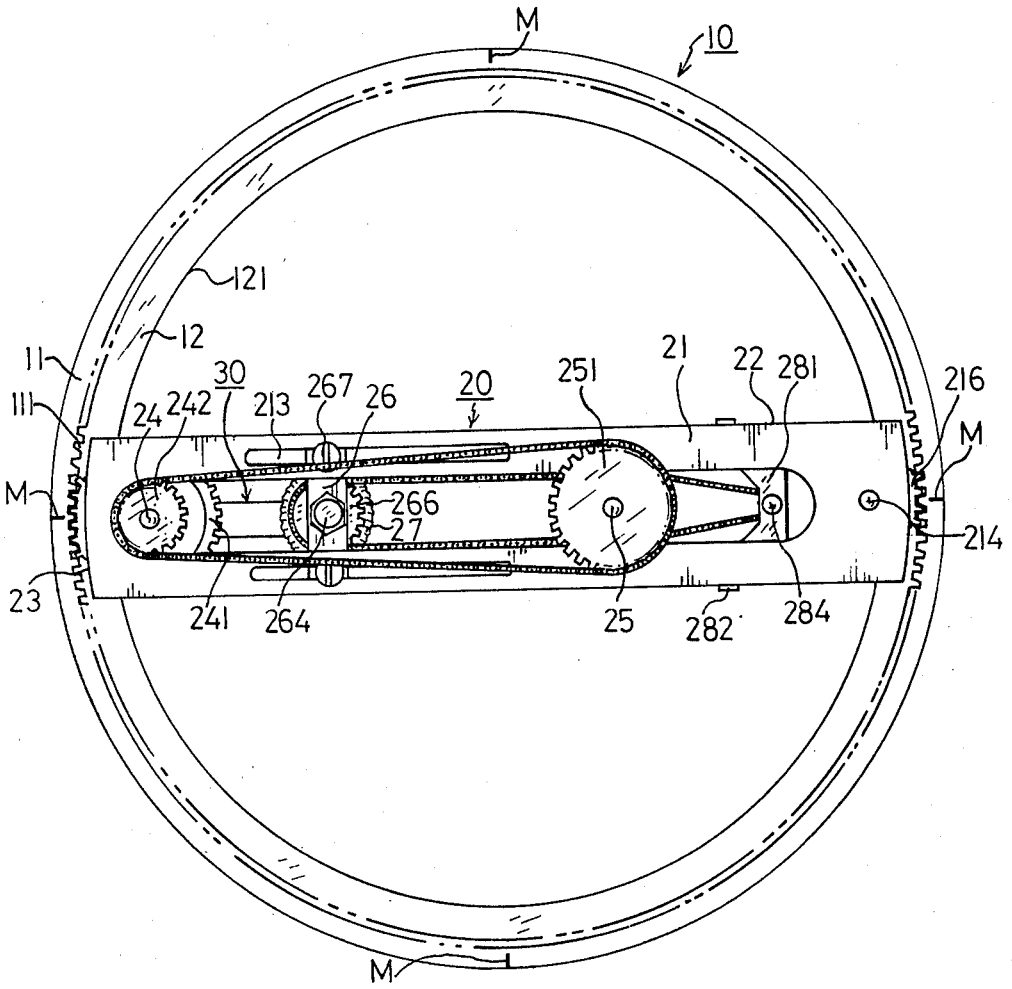
FIG. 1 is a top plane view of a preferred embodiment of the ellipsograph of the present invention with a partial cutaway.
Figure 2:
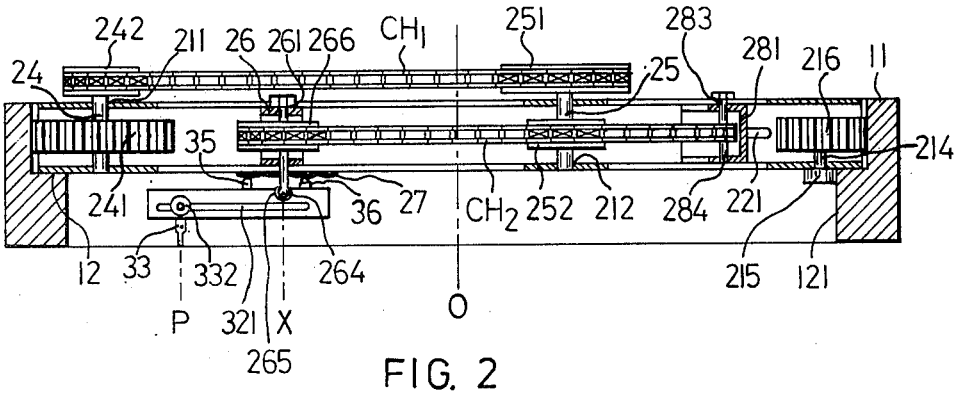
FIG. 2 is a diametrical section of the ellipsograph in FIG. 1.

Now referring to FIGS. 1 and 2, the ellipsograph of the present invention comprises mainly an inner toothed ring gear 10, a main seat bar 20 diametrically disposed within the ring gear 10 and rotatable about the center of the ring gear, and a drawing arm 30 which is mounted on a vertical shaft 264 under the seat bar 20 to rotate within the ring gear 10.

The ring gear 10 comprises a raised gear ring 11 with inner teeth 111 and, an inward projected flange 12 having a smooth inside wall 121, which flange is formed under the gear ring 11. The main seat bar 20 mounted across the inner diameter of ring gear 10 has a cross section 23 defined by a rectangular space bordered by upper and lower walls 21—21 and two side walls 22—22 of the seat bar 20. Disposed on the upper and lower walls 21—21 and close to the left end of the seat bar 20 are axle holes 211—211 which retain a vertical shaft 24. A spur gear 241 is mounted on the shaft 24 within the space 23. The spur gear 241 meshes with the teeth 111 of the ring gear 10. On the same shaft 24 and atop the upper wall 21 of the seat bar 20, a sprocket 242 is mounted. Both spur gear 241 and sprocket 242 are capable of rotating with the shaft 24. Just off the middle of the seat bar 20, on the upper and lower walls, axle holes 212—212 are provided to retain a vertical shaft 25 on which a sprocket 251 is mounted atop the upper wall 21 of seat bar 20, and another sprocket 252 is mounted within the space 23. Both sprockets 251 and 252 are rotatable with the shaft 25. Just off the right end of the seat bar 20, on the upper and lower walls 21—21, a further pair of axle holes is disposed to retain a vertical shaft 214 on which a spur gear 216 is mounted in the space 23. Spur gear 216 meshes with the teeth 111 of ring gear 10 and constitutes an idle gear for guide purpose. Under lower wall 21 of the seat bar 20 are mounted a pair of rollers 215—215 which are disposed near the side walls 22—22 and which press against the smooth inside wall 121 to be guided thereupon.

Pairs of elongated slots 213—213 are disposed on the upper and lower walls 21—21 of the seat bar 20 and between axle holes 211 and 212. A rectangular bracket 26 having axle holes 261—261 for retaining a vertical shaft 264 is slidably mounted within the space 23 of the seat bar at a position right under the slots 213—213. Screws 267 are used for setting the position of the bracket 26 through slots 213—213. A sprocket 266 is mounted on shaft 264 within the space 23 and is rotatable with the shaft 264.

On the front and rear side walls 22—22, at a position between shafts 25 and 214, a pair of elongated slots 221—221 are disposed. A generally V shaped idler bracket 281 is slidably mounted within the space 23 of the seat bar 20 between slots 221—221. Bracket 28 can be selectively set with screws 282 extending through slots 221—221. Axle holes 283—283 are provided on bracket 281 to retain a vertical shaft which carries an idler 284.

Figure 3:
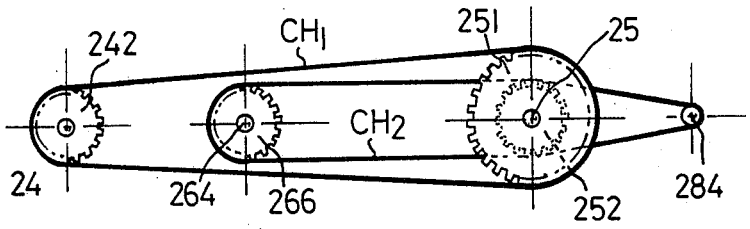
FIG. 3 is a schematic diagram of the transmission.

When the main seat bar 20 rotates inside the ring gear 10, gear 241 meshes with teeth 111 of the ring gear 10 and is driven thereby. Referring to FIG. 3, that movement is transmitted through gear 241 - shaft 24 - sprocket 242 - chain CH1 to sprocket 251, then through shaft 25 - sprocket 252 - chain CH2 - sprocket 266 to shaft 264. The shaft 264 is the shaft for driving a drawing arm 30 which shall be detailed later.

For the accuracy of ellipse drawing, the transmission adopted in the present invention constitutes a gearing and chain-sprocket system, and small pitch chains are preferably used. Besides, since the shaft 25 is fixed in place, the distance between shaft 264 and shaft 25 is adjustable, and the length of chain CH2 is fixed, the adjustable idler 284 is provided to give normal tension to the chain CH2. The following principle is observed so that when the seat bar 20 rotates one revolution within the ring gear 10, shaft 264 for the drawing arm 30 rotates two revolutions. A 90° rotation of the seat bar 20 results in a 180° rotation of the drawing arm 30, and their directions of rotation oppose each other.

Figure 4:
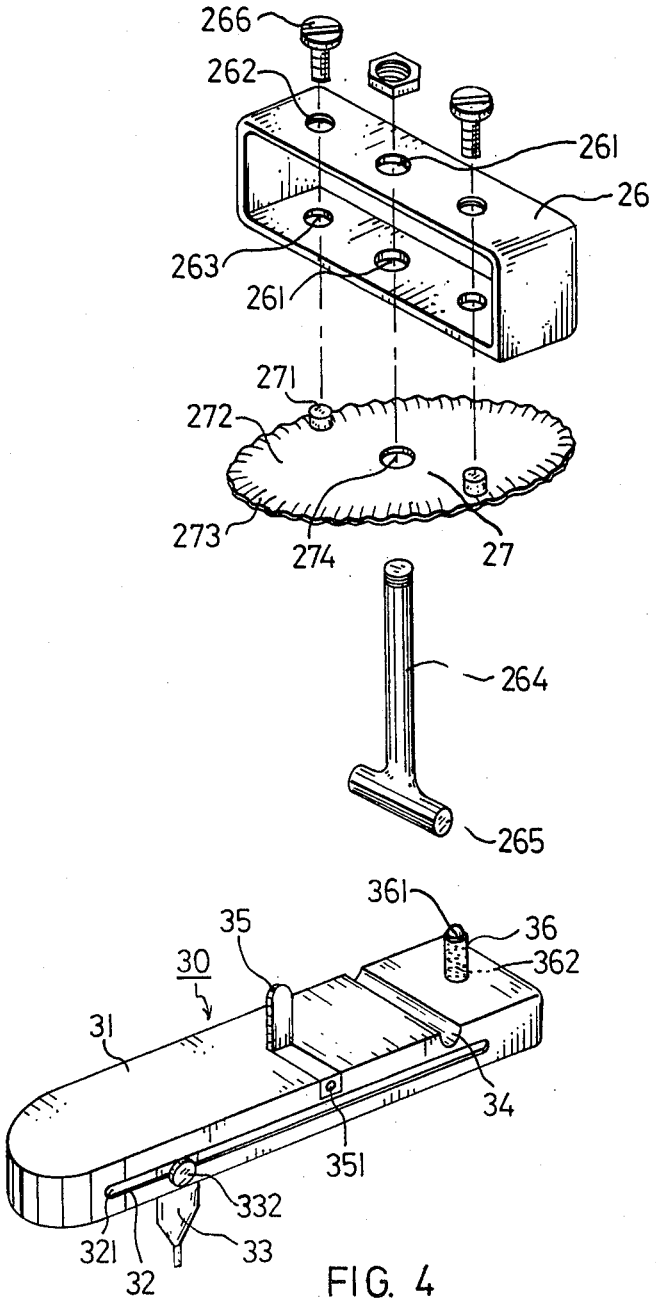
FIG. 4 is an exploded view of the vertical shaft and the revolving arm.

Refer now to FIG. 4 for the details of the drawing arm. The drawing arm shaft 264 is generally of an inverted T shape, the cross bar 265 thereof being inserted in a lateral groove 34 provided on one end of the arm 30 so that the arm 30 can rotate with the shaft 264.

Drawing arm 30 comprises a hollow body 31 having elongated slots 321 disposed along front and rear side walls 32 thereof and extending beneath groove 34. A drawing implement 33 such as a pen or a pencil is slidably mounted between slots 321—321 and can be adjustably set by a screw 332.

Slidably attached under the lower wall 21 of the seat bar 20 is a disc 27 which has a pair of dimetrically disposed projections 271—271 extending upwardly through slots 213—213 and into a pair of holes 263—263 formed on an underside of the bracket 26. The center hole 274 of the disc 27 receives the shaft 264 which rotates freely therein. The disc 27 comprises a planar portion 272 extending radially from the disc center to about $\frac{2}{3}$ of the radius. The edge of the disc, or the remaining $\frac{1}{3}$ of the radius portion, is of corrugated shape 273.

On the end of arm 30 where groove 34 is located, a ball member 36 is provided. The ball 36 is biased by a spring 362 contained in a seat 363 which is screwed onto the arm 30. When drawing arm shaft 264 is inserted into the groove 34 and the disc 27 is assembled, the ball member 36 contacts the underside of the planar portion 272 of the disc 27. The spring 362 can maintain a proper pressure on the drawing implement 33 when the drawing arm 30 is rotated so that a perfect contact between the implement 33 and the drawing paper thereunder can be ensured.

If a dotted ellipse is desired, a projected attachment 35 can be added to the arm 30 having a height equal that of the ball member 36 by screwing a bent mounting portion of the attachment to the side wall 32 of the arm 30 at 351. When the arm 30 rotates about the shaft 264, projection 35 follows the corrugated portion 273 of the disc 27 so that, a dotted ellipse is drawn. Projection 35 may be made in an insertable form to ease detachment when not in need.

Figure 5:
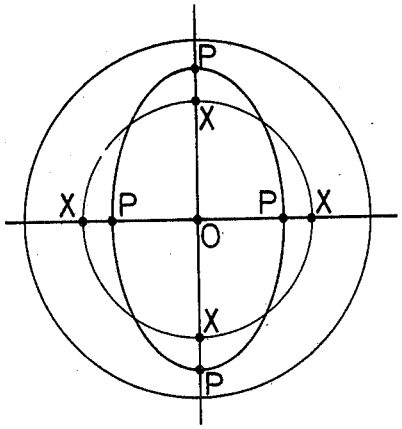
FIG. 5 is a diagram showing the principle of the ellipsograph of the present invention.

Pairs of diametrically opposed cross marks M are carved on the top 11 of the ring gear 10 such that, the intersect point O of the diameters constitutes the center of the ring gear 10. The main seat bar rotates about this center O. Assuming the distance between the center O and the center of the shaft 264 to be $\overline{OX}$ and, the distance between the center of shaft 264 and that of the drawing implement 33 to be $\overline{XP}$, the ellipse formed therefrom shall have a major axis of $2(\overline{OX}+\overline{XP})$ and a minor axis of $2(\overline{OX}-\overline{XP})$. This may be clearly seen from FIG. 5, and the difference of the major axis and the minor axis being $4\overline{XP}$.

In using the ellipsograph of the present invention, before rotating the main seat bar 20, screws 282 are loosened to release idler 284 so that the chain CH2 is loosened. Then screws 267 are reset to create the distance $\overline{OX}$ to tighten the chain CH2, the idler 284 is fixed by setting screws 282. The distance $\overline{XP}$ between the center P of drawing implement 33 and the center X of drawing arm shaft 264 can be adjusted according to the relation: (major axis−minor axis)$=4\overline{XP}$ through adjustment of the screw 331 of the drawing implement 33 on the arm 30.

A numerical example is hereby given to express the application. In case an ellipse having a major axis of 8 cm and a minor axis of 4 cm is desired to be drawn, the difference between the major axis and the minor axis being $8-4=4$ cm$=4\overline{XP}$, $\overline{XP}=1$ cm. Adjust the distance between center P of the drawing implement 33 and the center X of the drawing arm shaft 264 to be 1 cm and set the screw 331. Since $(\overline{XP}+\overline{OX})=$ major axis, then $\overline{XO}=3$ cm., the distance between the center X of the drawing arm shaft and the center O of the ring gear is adjusted to equal 3 cm. Graduations of length can be provided on the main seat bar 20 (not shown) to facilitate measurement. When drawing, put the ring gear horizontally on a piece of paper on which the ellipse is to be drawn, hold the ring gear with one hand, and revolve the main seat bar with another hand along the ring gear for 360°, whereby the desired ellipse is thereby drawn.

The above embodiment is given only for illustration purpose and not by way of limitation, and modification will become evident to those skilled the art, such as simplification of the way of in setting the screw of the drawing arm shaft, and the adjustment of the idler to be effected by biasing it with a tension spring in a conventional way, etc., providing that those modifications would not result in any bad effect to the precision of the instrument, which will fall within the scope of the attached claims.

We claim:

1. An ellipsograph comprising:

a ring gear having internal teeth;

a main seat bar disposed diametrically within said ring gear and being rotatable about the center of said ring gear;

a vertical shaft mounted on said seat bar;

an arm mounted on said shaft for rotation therewith;

a drawing implement adjustably mounted on said arm;

a drive gear mounted on one end of said seat bar and meshes with said inner teeth of said ring gear; and chain drive means drivingly interconnecting said drive gear with said vertical shaft so that rotation of said main seat bar produces rotation of said drive gear which is transmitted to said vertical shaft for rotating said arm to produce an ellipse whose major axis equals twice the sum of a first value defined by the distance between the center of said ring gear and said vertical shaft and a second value defined by the distance between said vertical shaft and said drawing implement, and whose minor axis equals twice the difference between said first and second values.

2. Apparatus according to claim 1, wherein said chain drive means comprises:

a second vertical shaft mounted on said main seat bar and carrying said drive gear and a first sprocket;

a third vertical shaft adjustably mounted on said main seat bar and carrying second and third sprockets;

said first vertical shaft carrying a fourth sprocket;

a fourth vertical shaft adjustably mounted on said main seat bar and carrying an idler sprocket;

all of said vertical shafts being mutually parallel;

said first and second sprockets being disposed in a common first horizontal plane;

a first endless chain interconnecting said first and second sprockets to transmit rotation from said second vertical shaft to said third vertical shaft;

said third sprocket, fourth sprocket, and idler sprocket being disposed in a common second horizontal plane spaced from said first plane; and a second endless chain interconnecting said third sprocket, fourth sprocket, and idler sprocket to transmit rotation from said third shaft to said first shaft.

3. Apparatus according to claim 2 wherein said main seat bar comprises vertically spaced upper and lower walls, said walls containing aligned slots in which said first and fourth shafts are mounted for equal adjustments.

4. Apparatus according to claim 2 wherein said first shaft has an inverted-T shape including a vertical portion and a horizontal cross bar; said arm including a groove at one end which receives said cross bar; said arm including horizontally spaced side walls having aligned slots extending along said arm and beneath said groove; said drawing implement being adjustably mounted in said last-named slots.

5. Apparatus according to claim 4 including a disc through which said first shaft is loosely disposed; said disc disposed above said arm and comprising a planar central portion occupying about $\frac{2}{3}$ of the radius of said disc and a corrugated outer edge portion occupying the remaining radius of said disc; said arm carrying a ball spring-biased into contact with said planar portion of said disc, and a projection contacting said corrugated portion of said disc and generally following the contour thereof to displace said drawing implement in a manner producing a dotted ellipse.

6. Apparatus according to claim 1 wherein a guide gear is mounted on one end of said main seat bar opposite the other end thereof carrying said drive gear, said guide gear freely meshing with said internal teeth of said ring gear; and a pair of guide rollers mounted at said one end of said main seat bar and guidingly contacting a smooth inner wall of said ring gear disposed below said inner teeth.

* * * * *